US005929357A

United States Patent [19]

Masubuchi

[11] Patent Number: 5,929,357

[45] Date of Patent: Jul. 27, 1999

[54] KEYBOARD ASSEMBLY HAVING PLURALITY OF KEYS FORMED INTEGRALLY WITH COMMON KEY SUPPORT

[75] Inventor: Takamichi Masubuchi, Shizuoka-ken, Japan

[73] Assignee: Yamaha Corporation, Hamamatsu, Japan

[21] Appl. No.: 09/108,788

[22] Filed: Jul. 2, 1998

[30] Foreign Application Priority Data

Jul. 3, 1997 [JP] Japan ..... 9-192036

[51] Int. Cl.[6] ..... G10C 3/12

[52] U.S. Cl. ..... 84/423 R; 235/145 R; 84/438; 400/472

[58] Field of Search ..... 84/438, 423 R, 84/441, 433, 434, 436; 400/490, 492, 495, 496, 472; 235/145 R; 984/61

[56] References Cited

U.S. PATENT DOCUMENTS

| | | | |
|---|---|---|---|
| 2,844,065 | 7/1958 | Corwin | 84/423 R |
| 3,129,660 | 4/1964 | Miller | 400/472 |
| 3,797,357 | 3/1974 | Thomas et al. | 84/423 R |
| 4,043,244 | 8/1977 | Schrecongost et al. | 84/423 R |
| 4,464,325 | 8/1984 | Kondo et al. | 84/438 |
| 4,488,472 | 12/1984 | Kumano et al. | 84/434 |
| 4,914,999 | 4/1990 | Masubuchi et al. | 84/423 R |

FOREIGN PATENT DOCUMENTS

| | | |
|---|---|---|
| 1043959 | 9/1989 | Japan . |
| 5096889 | 12/1993 | Japan . |

*Primary Examiner*—Edgar Burr
*Assistant Examiner*—Leslie J. Grohusky
*Attorney, Agent, or Firm*—Loeb & Loeb LLP

[57] ABSTRACT

A keyboard assembly comprises at least one key unit including a plurality of keys each having a front end and a base end, a common key support supporting the keys, and a connecting portion provided on the base end of each of the keys and connecting between each of the keys and the common key support. The keys are formed integrally with the connecting portion and the common key support in a manner such that the keys are each connected via the connecting portion to the common key support for swinging about the common key support in a direction of depression and release of the keys and in a direction in which the keys are juxtaposed. The keys define gaps therebetween, each of which becomes progressively larger toward the front end of an associated one of the keys. Guided projections are provided on the keys, and guides on a frame in which the key unit is mounted, for causing the keys to run parallel with each other by deforming the connecting portion of each of the keys to thereby engage the key unit with the frame.

10 Claims, 7 Drawing Sheets

KEYBOARD ASSEMBLY HAVING PLURALITY OF KEYS FORMED INTEGRALLY WITH COMMON KEY SUPPORT

BACKGROUND OF THE INVENTION

1. Field of the Invention

The present invention relates to a keyboard assembly which is formed of key units molded in single pieces from a mold, and a frame in which the key units are mounted.

2. Prior Art

Conventional keyboard assemblies for use in electronic organs and the like include a type in which key units are mounted in a frame forming part of a casing. The key units are each constructed such that a plurality of keys are joined to a common key support via respective connecting portions, the keys, the common key support, and the connecting portions being formed in one piece to simplify the manufacturing process. In a keyboard assembly of this type, however, keys of the key unit are juxtaposed with very small gaps defined between adjacent keys, which necessitates forming a mold for forming the key unit in one piece such that portions or ribs of the mold corresponding to the gaps are very small in thickness. Therefore, the mold has degraded strength and is difficult to fabricate. To cope with this, in the conventional keyboard assembly, instead of making one white key unit per octave, two white key units are made per octave by separately molding them, and then putting the key units together. This leads to a complicated manufacturing process.

In attempt to eliminate these disadvantages, there has been proposed a method of manufacturing a keyboard assembly by Japanese Patent Publication (Kokoku) No. 1-43959, which has a plurality of keys molded in one piece with base ends thereof joined together to serve as a common key support such that gaps between adjacent keys become progressively larger toward front or free ends thereof, and after the molding, the base ends or common key support is forcibly deformed such that the keys extend just parallel with each other.

The proposed method employs two manufacturing manners. According to a first manufacturing manner, an elastic metal sheet which assumes a straight comb-like shape in a free state is used as a material for forming part of the common key support in the completed key unit. The metal sheet with base ends of the keys connected to a comb-shaped side thereof is set into a mold in a state being resiliently deformed in the form of an arc with its comb-shaped side extended, followed by pouring hot resin into the mold. With cooling and curing of the resin, the base ends of the keys become secured to teeth of the extended comb-shaped side of the metal sheet, so that a key unit is formed with the keys radially extending. Then, the metal sheet is released from the resiliently deformed state, whereby the key unit is completed with the keys integrally formed with the comb-shaped side of the metal sheet and extending parallel with each other.

According to a second manufacturing manner, a common connecting portion (base ends) which is curved in a free state and white keys are formed in one piece by molding such that the white keys radially extend from the connecting portion, and after the molding, the connecting portion is forcibly resiliently deformed such that the white keys extend parallel with each other, and then black keys are secured by set screws to predetermined portions of the white keys to form a key unit with white keys and black keys. The key unit is then mounted in a frame. V-shaped or U-shaped grooves are formed in a rear side of the connecting portion at locations between adjacent white keys to facilitate resilient deformation of the connecting portion.

According to the first manufacturing manner, the resiliently deformable common key support has to be separately fabricated in advance, and further, a step of resiliently deforming the common key support with its comb-shaped side extended is required when setting the same into the mold, thus making the manufacturing process complicated and hence still leaving room for further improvement in the simplicity of the manufacturing process.

According to the second manufacturing manner, the key unit is mounted in the frame with the connecting portion resiliently deformed. As a result, a feeling of rubbing of adjacent keys is generated due to variations in size and shape. Moreover, residual stress is present in the connecting portion, which can cause loosening of set screws in the connecting portion after the lapse of a long time after delivery of the product and hence causing a feeling of rubbing of adjacent keys. Thus, the product is disadvantageous in respect of quality and performance.

SUMMARY OF THE INVENTION

It is an object of the invention to provide a keyboard assembly which facilitates the design of the mold and is easy to manufacture without requiring complicated manufacturing steps and causing degradation of the quality and performance, and hence has improved strength as well as a prolonged life.

To attain the above object, the present invention provides a keyboard assembly comprising at least one key unit including a plurality of keys each having a front end and a base end, a common key support supporting the keys, and a connecting portion provided on the base end of each of the keys and connecting between the each of the of keys and the common key support, the keys being formed integrally with the connecting portion and the common key support in a manner such that the keys are each connected via the connecting portion to the common key support for swinging about the common key support in a direction of depression and release of the keys and in a direction in which the keys are juxtaposed, the keys defining gaps therebetween, each of the gaps becoming progressively larger toward the front end of an associated one of the keys, a frame in which the key unit is mounted, and engaging means provided on the keys and the frame, for causing the keys to run parallel with each other by deforming the connecting portion of each of the keys to thereby engage the key unit with the frame.

With the above arrangement, in manufacture, the key unit is molded in one piece such that gaps defined between the keys each become progressively larger toward the front end of an associated one of the keys. As a result, it is possible to increase the thickness of portions of a mold which is used to form the key unit, corresponding to the gaps of the keys, to a larger thickness, to thereby facilitate the design and manufacture of the mold and improve the strength as well as prolong the life. In mounting the key unit into the frame, the connecting portions of the key unit are deformed to cause the keys to run parallel with each other. Thus, the keys which, in a free state, extend diagonally from the common key support, can be easily made to run parallel with each other, thereby avoiding complicated manufacturing steps as well as degradation of the quality and performance.

Preferably, the engaging means comprises guide means provided on the frame, and guided means provided on each of the keys and engaging a corresponding one of the guide means, the keys being caused to run parallel with each other by engagement of the guide means with the guided means.

With the above arrangement, the keys are caused to run parallel with each other by engagement of the guide means provided on the frame with the guided means provided on the keys. Since the guide means and the guided means are always held in engagement with each other, the gaps between the keys can be maintained at proper clearances.

Advantageously, the guide means are configurated so as to cooperate with the guided means to restrain swinging of the keys in the direction in which the keys are juxtaposed when the keys are depressed.

With the above arrangement, the guide means and the guided means do not only perform a key-guiding function as performed by conventional guide means and guided means, but also perform a function of bringing the keys into parallel extending positions, thus simplifying the construction.

Preferably, the guide means and the guided means are in urging face-to-face contact with each other to thereby cause the keys to run parallel with each other.

With the above arrangement, the guide means and guided means for each of the keys are in slidable face-to-face contact with each other always at the same side surfaces thereof during key-depressing operation, to thereby secure proper clearances between the keys and prevent generation of mechanical noise during key-depressing operation.

In a preferred form of the invention, the guide means comprises a pair of walls provided on the frame at a location corresponding to each of the keys and defining a channel therebetween, the pair of walls having opposite side surfaces and extending parallel with a longitudinal axis of the each of the keys when the key unit is mounted in the frame, the pair of walls being spaced from each other and defining a channel therebetween, the guided means comprising a projection provided on the each of the keys and extending parallel with the longitudinal axis of the each of the keys, the projection being inserted in the channel between the pair of walls of a corresponding one of the guide means.

Preferably, the connecting portion of the key unit is bent in the direction in which the keys are juxtaposed, such that each of the gaps becomes progressively larger toward the front end of an associated one of the keys.

Since the connecting portion, which is small in mass, has a small restitution force, the keys can be easily brought into parallel extending positions, eliminating a feeling of rubbing of adjacent keys.

In a preferred form of the invention, the connecting portion comprises a vertically extending portion located closer to the key support and allowing the each of the keys to be bent about the vertically extending portion while allowing the each of the keys to be swung in the direction in which the keys are juxtaposed, and a horizontally extending portion located closer to the each of the keys and allowing the each of the keys to be swung in the direction of depression and release of the keys.

Preferably, the guided means comprises a first projection provided on the each of the keys for engagement with a corresponding one of the guide means, and a second projection projected from the first projection outwardly of a side surface of the each of said keys in the direction in which the keys are juxtaposed.

With the above arrangement, since the second projection is laterally projected outwardly of the key, a mold used to form the key unit can be formed without an undercut formed therein, which would be needed for formation of the second projection if the second projection is projected axially or longitudinally of the key, thereby reducing the cost for forming the mold and hence reducing the manufacturing cost of the keyboard assembly.

More preferably, the keyboard assembly includes a stopper provided on the frame, and the second projection of the guided means has an engaging surface disposed for abutment with the stopper when the each of the keys is released, to limit an extreme position of the each of the keys.

With the above arrangement, the second projection serves as an upper limit stopper to limit an extreme position of the corresponding key when it is released. As a result, the keyboard assembly can be compact in size and can be made of a reduced number of component parts. Besides, the guided projection of the key and the second projection are located in proximity to each other so that they can be formed integerally in one piece with the main body of the key, enabling a further reduction of the manufacturing cost.

In another preferred form of the invention, the guide means comprises a pair of walls provided on the frame at a location corresponding to each of the keys and defining a channel therebetween, the pair of walls having opposite side surfaces and extending parallel with a longitudinal axis of the each of the keys when the key unit is mounted in the frame, the pair of walls being spaced from each other and defining a channel therebetween, the guided means comprising a projection provided on the each of the keys and extending parallel with the longitudinal axis of the each of the keys, the projection being inserted in the channel between the pair of walls of a corresponding one of the guide means in a fashion such that the projection is sandwiched at the opposite side surfaces thereof between the pair of walls.

With the above arrangement, the pair of wall of the guide means are in face-to-face contact with the guided means, which can be preferably in the form of a plate, at opposite lateral sides of the key to restrain movement of the key, thereby preventing rolling of the key about a longitudinal axis thereof, and hence enabling achievement of stable swinging motions of the keys when they are depressed and released.

The above and other objects, features, and advantages of the invention will become more apparent from the following detailed description taken in conjunction with the accompanying drawings.

DETAILED DESCRIPTION

The invention will be described in detail with reference to the drawings showing a preferred embodiment thereof.

Figure 1:
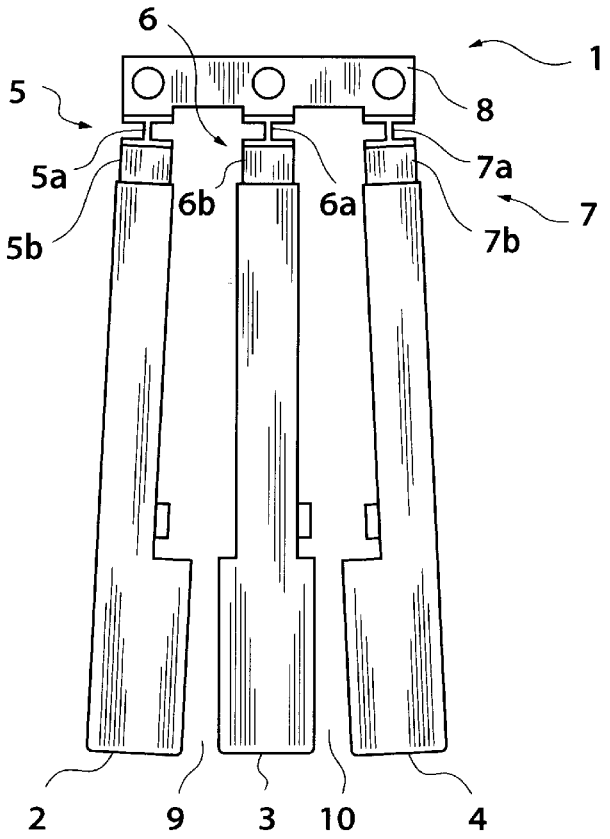
FIG. 1 is a top plan view of a key unit of a keyboard assembly according to a first embodiment of the invention.
Figure 2:
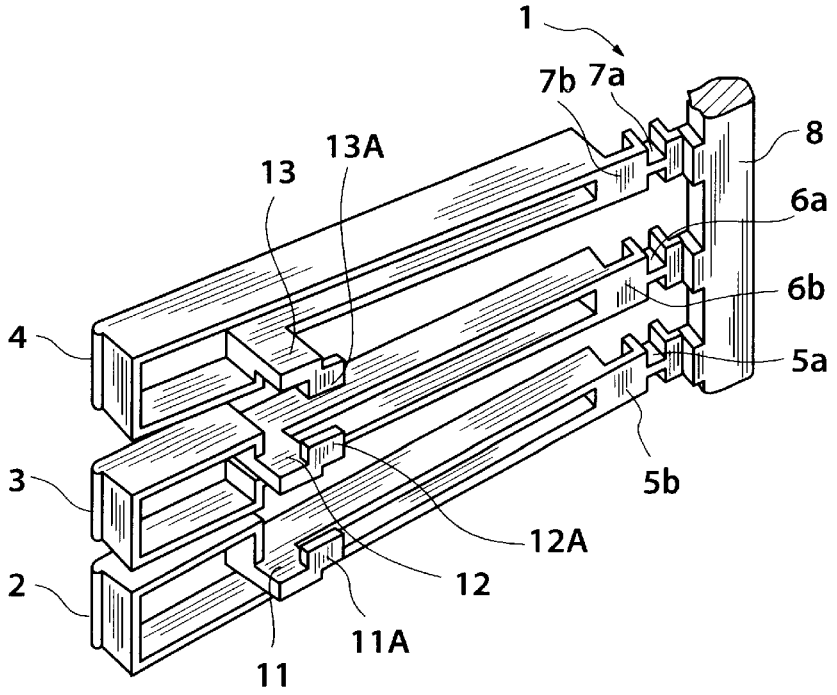
FIG. 2 is a perspective view of the key unit assembly of FIG. 1 as viewed from a frontward and lateral side thereof.

FIGS. 1 and 2 show a key unit used in a keyboard assembly according to a first embodiment of the invention.

The key unit 1 is comprised of keys 2, 3 and 4 connected to a common key support 8 via respective connecting portions 5, 6 and 7, the keys, common key support, and connecting portions being formed in one piece from a mold. The connecting portion 5 is formed of a vertically extending rear half portion (hereinafter referred to as "the vertical portion") 5*a,* and a horizontally extending front half portion (hereinafter referred to as "the horizontal portion") 5*b*. The vertical portion 5 is resiliently deformable in a horizontal direction so as to allow the key 2 to be swung in a direction in which the keys are juxtaposed (hereinafter referred to as "the transverse direction"), and the horizontal portion 5*b* is also resiliently deformable so as to allow the key 2 to be swung in a direction in which the key 2 is depressed and released. In the present embodiment, the keys 2, 3, and 4 are configurated for use as a C key, a D key, and an E key, respectively.

The connecting portions 6 and 7 also have vertical portions 6*a,* 7*a* and horizontal portions 6*b,* 7*b* which are arranged and configurated similarly to the vertical and horizontal portions 5*a,* 5*b* of the connecting portion 5.

The key 3 has a longitudinal axis thereof extending perpendicularly to the common key support 8, while the key 2 has a longitudinal axis thereof bent at the vertical portion 5*a* of the connecting portion 5 and extending diagonally to the left of the common key support 8, and the key 4 has a longitudinal axis thereof bent at the vertical portion 7*a* of the connecting porion 7 and extending diagonally to the right of the common key support 8, as viewed in FIG. 1. Accordingly, when the key unit 1 is in a free state, gaps between the keys 2,3 and 4, i.e. a gap 9 between the keys 2 and 3 and a gap 10 between the keys 3 and 4 become progressively larger toward front or free ends of the keys.

The key unit 1 is molded in one piece from a mold, not shown, which consists of a moving mold and a stationary mold. The mold is configurated so as to form the key unit 1 in a shape shown in FIG. 1, described above, i.e. the keys 2, 3, and 4 extend such that gaps therebetween progressively expand toward the front ends thereof. Therefore, it can be avoided that the mold has ribs with very small thickness corresponding to the gaps 9, 10.

The keys 2, 3, and 4 each have a front portion thereof formed integrally with a guided projection 11, 12, 13 pending therefrom. Each guided projection 11, 12, 13 has an integral small protuberance 11A, 12A, 13A projected in a rearward direction as well as in a sideward.direction (in the transverse direction), i.e. in a direction in which an elastic force or biasing force of the corresponding connecting portion 5, 6, 7 due to deformation thereof acts. Each small projection 11A, 12A, 13A has an engaging surface 11*a,* 12*a,* 13*a* facing toward a main body of the corresponding key, for abutment with an upper limit stopper 17, hereinafter referred to, when the key is released, thus forming an abutment device for abutment with the stopper 17.

Figure 3:
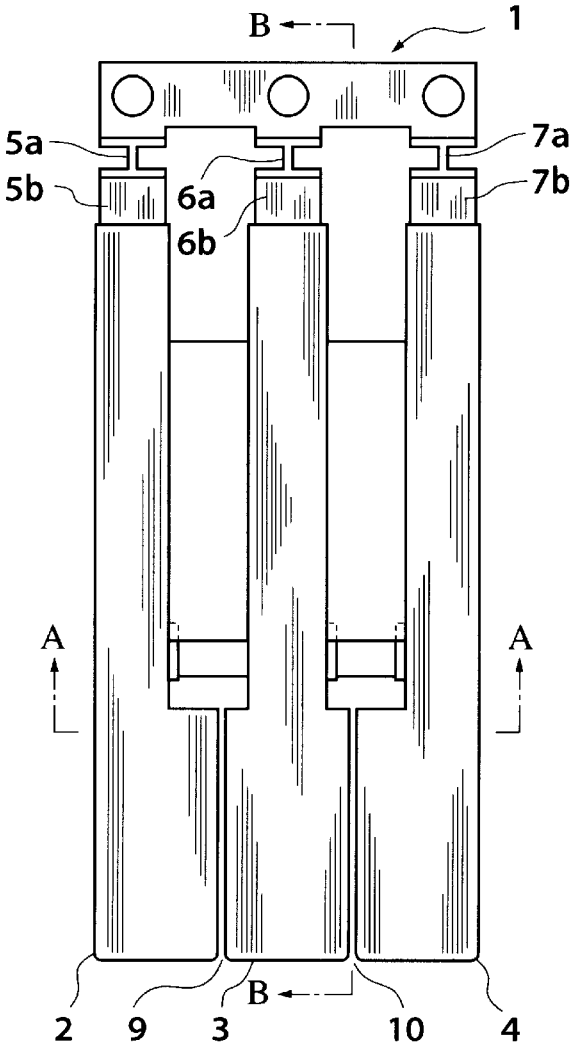
FIG. 3 is a top plan view of the keyboard assembly of FIG. 1 in a state where the key unit is mounted in a frame.
Figure 4:
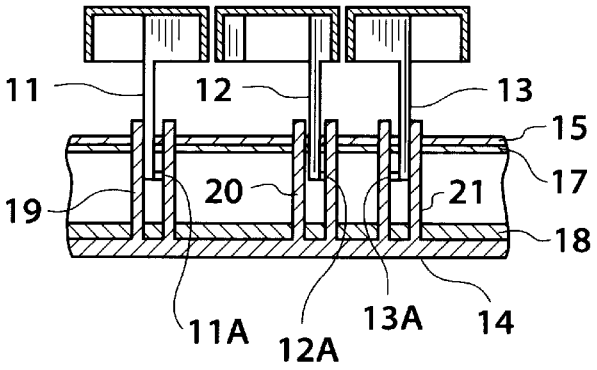
FIG. 4 is a sectional view taken along line A—A in FIG. 3.

FIGS. 3 to 6 show the key unit 1 according to the present embodiment, which is mounted in a frame. FIG. 7 is an enlarged view of FIG. 4, showing details of the keys and guides.

In the figures, the key unit 1 is mounted in a frame 14. In mounting the key unit 1 into the frame 14, the key unit 1 is straightened or deformed from the expanded state shown in FIGS. 1 and 2 into a state where the keys 2, 3, and 4 extend parallel with each other as shown in FIG. 3. The deformation of the key unit 1 from the expanded state is made by means of guides 19 and 21 and the guided projections 11 and 13, as hereinafter described.

Figure 5:
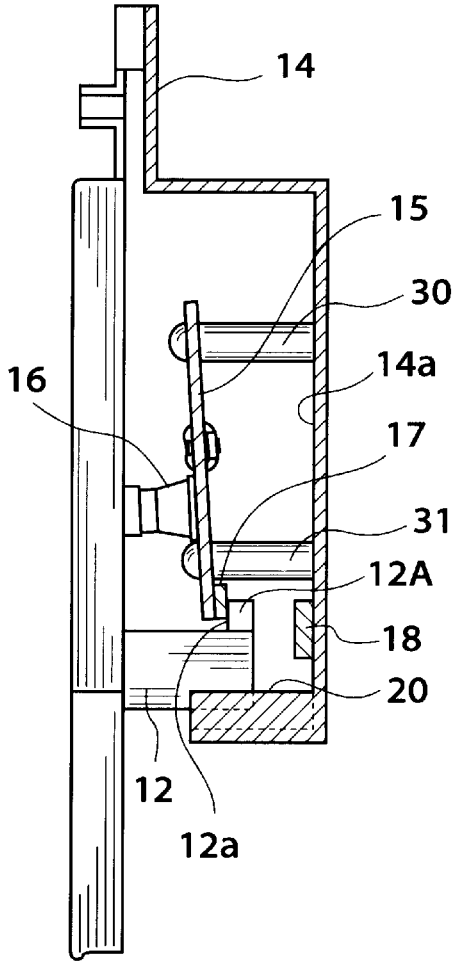
FIG. 5 is a sectional view taken along line B—B in FIG. 3.

As shown in FIGS. 4 and 5, the frame 14 has a bottom surface 14*a* on which a printed circuit board 15 is fixed via spacers 30 and 31. The printed circuit board 15 is provided with key switches 16 for detecting key-depressing operations of the keys, and the upper limit stopper 17 disposed for abutment with the engaging surfaces 11*a,* 12*a,* and 13*a* of the small protuberances 11A, 12A, and 13A of the keys 2, 3, and 4, for limiting upper limit positions of the keys 2, 3, and 4 during key-release operations.

The frame 14 has a lower limit stopper 18 provided on the bottom surface 14*a* and disposed for abutment with the guided projections 11, 12, and 13 of the keys 2, 3, and 4, for limiting lower limit positions of the keys 2, 3, and 4 during key-depressing operations. The frame 14 further has the guides 19, 20, and 21 formed integrally on the bottom surface 14*a,* for engagement with the respective guided projections 11, 12, and 13, as shown in FIGS. 4 and 7. The guides 19, 20, and 21 do not only perform a key-guiding function of restraining the keys 2, 3, and 4 from being swung in the transverse direction during key-depressing operation after the completion of the key assembly, similarly to the conventional keyboard assembly, but also perform a straightening function of straightening the key unit 1 from the expanded state in mounting the key unit 1 into the frame 14, through engagement with the guided projections 11, 12, and 13.

Figure 6:
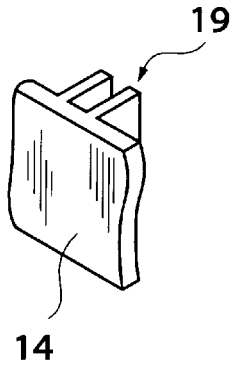
FIG. 6 is a perspective view of a guide of the keyboard assembly.
Figure 7:
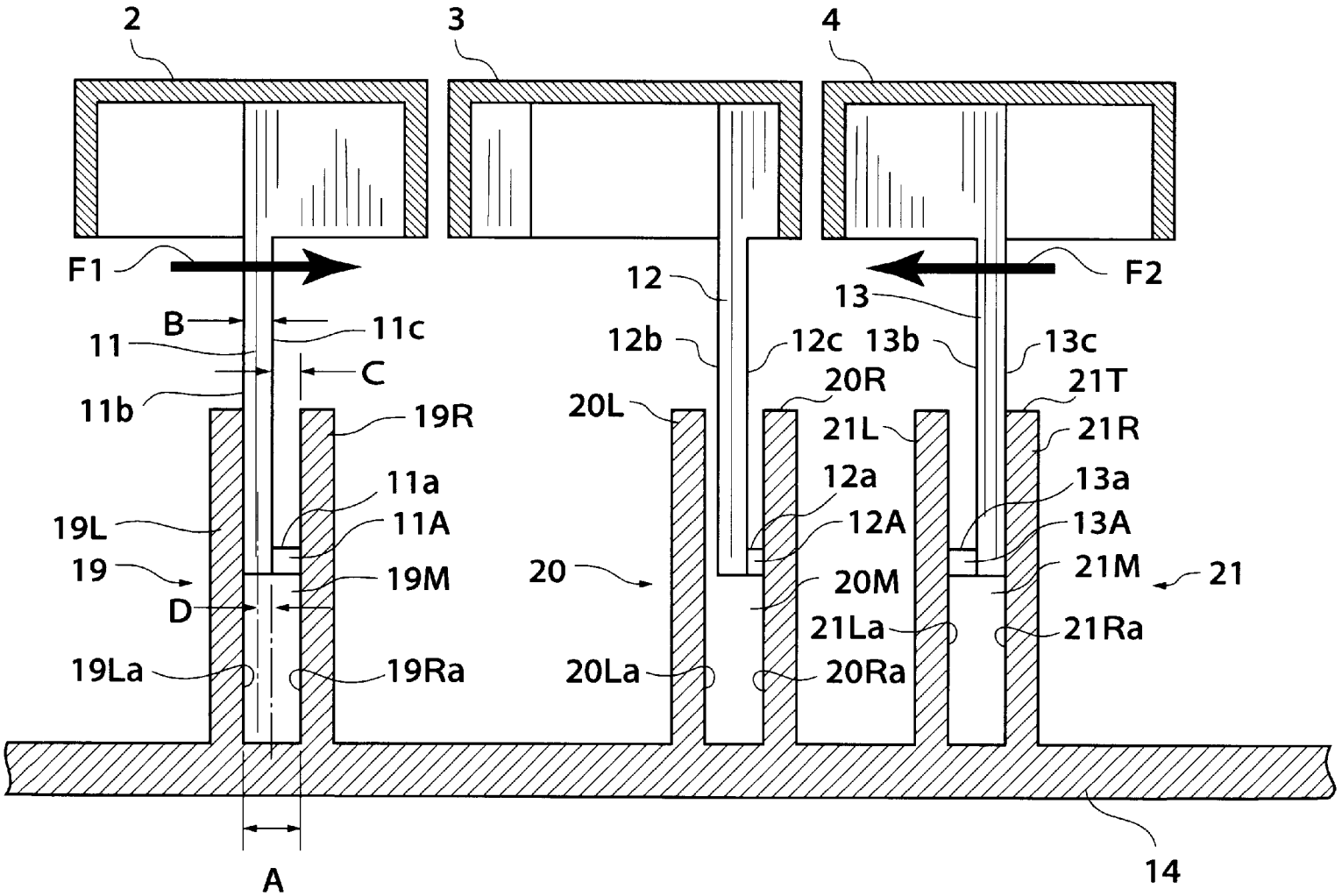
FIG. 7 is an enlarged sectional view taken along line A—A in FIG. 3, showing in detail keys and guides of the keyboard assembly.

As shown in FIGS. 4, 6, and 7, the guide 19 is formed integrally on the frame 14 at a front portion thereof. The guide 19 is formed of a pair of left wall 19L and right wall 19R projected from the bottom surface 14*a* of the frame 14 in spaced relation to each other and defining a channel 19M therebetween. The left and right walls 19L, 19R are disposed on the frame 14 such that they extend parallel with the longitudinal axis of the corresponding key 2 when the key unit 1 is mounted in the frame 14. The other guides 20 and 21 are configurated and disposed similarly to the guide 19, that is, the guide 20 is formed of a pair of left wall 20L and right wall 20R having side surfaces 20L*a* and 20R*a* and defining a channel 20M therebetween, and the guide 21 is formed of a pair of left wall 21L and right wall 21R defining a channel 21M therebetween. The height and longitudinal size of the guides 19, 20, and 21 are set to such values that the channels 19M, 20M, and 21M are maintained in engagement with the respective guided projections 11, 12, and 13 during key-depressing operation of the key unit 1.

In mounting the key unit 1 constructed as above into the frame 14, the guided projections 11, 12, and 13 of the keys 2, 3, and 4 are inserted into the respective channels 19M, 20M, and 21M by manual operation, and the key unit 1 is secured to the frame 14 at the common key support 8 by means of set screws or the like, not shown. When the key unit 1 is thus mounted in the frame 14, the key 2 tends to return to the left, and the key 3 to the right as viewed in FIG. 3, due to the restitution force, and consequently the guided projection 11 has its left side surface 11*b* brought into urging face-to-face contact with a right side surface 19L*a* of the left wall 19L of the guide 19, to thereby limit a leftmost position of the key 2. Thus, the key 2, which is bent about the vertical portion 5*a* of the connecting portion 5 when the key unit 1 is in a free state, is corrected in position in a key-straightening direction F1 in FIG. 7. Similarly, the guided projection 13 has its right side surface 13*c* brought into urging face-to-face contact with a left side surface 21R*a* of the right wall 21R of the guide 21 to thereby limit a rightmost position of the key 4. Thus, the key 4, which is bent about the vertical portion 7*a* of the connecting portion 7 when the key unit 1 is in a free state, is corrected in position in a key-straightening direction F2 in FIG. 7. In this way, the keys 2 and 4 are easily corrected in position from the expanded state where the gaps 9 and 10 become progressively larger toward the front ends, to bring the keys 2, 3, and 4 into parallel extending positions as shown in FIG. 3.

To secure the urging face-to-face contact between the guides 19, 20, and 21 and the guided projections 11, 12, and 13, the dimensional and positional relationship between the channels 19M, 20M, and 21M and the guided projections 11, 12, and 13 is set as follows:

First, to set the width of each of the channel 19M and the guided projection 11, if the width of the channel 19M is designated by A, and that of the guided projection 11 by B, the gap (clearance) C between the right side surface 11*c* of the guided projection 11 and the left side surface 19R*a* of the right wall 19R of the guide 19 should be C=A−B.

The distance (deviation) D between the center line of the channel 19M and the center line of the guided projection 11 is set to approximately half of the clearance C, i.e. D=(A−B)/2. By this setting, the left side surface 11*b* of the guided projection 11 and the right side surface 19L*a* of the left wall 19L of the guide 19 can be maintained in urging face-to-face contact with each other (sliding face-to-face contact in normal key-depressing operation), while a proper clearance C is secured at a side of the guided projection 11 remote from the left side surface 11*b* in urging face-to-face contact.

The dimensional and positional relationship between the channel 21M and the guided projection 13 is set similarly to that between the channel 19M and the guided projection 11 described above, but the former should be symmetrical with the latter. Thus, the right side surface 13*c* of the guided projection 13 and the left side surface 21R*a* of the right wall 21R of the guide 21 can be maintained in urging face-to-face contact with each other (sliding face-to-face contact in normal key-depressing operation), while a proper clearance C is secured at a side of the guided projection 13 remote from the right side surface 13*c* in urging face-to-face contact.

As regards the dimensional and positional relationship between the channel 20M and the guided projection 12, since they do not take part in the straightening of the key unit 1, they have only to be dimensioned and positioned such that the center line of the channel 20M approximately agrees with that of the guided projection 12. By this setting, the guided projection 12 is always kept in spaced relation to the guide 20 without contacting the same, while a proper clearance can be secured at either side of the guided projection 12 (the sum of clearances at opposite sides of the guided projection 12 is equal to the clearance C).

In the above described manner, the correction of the gaps 9 and 10 is achieved by the face-to-face contact of one side surfaces of the guided projections 11, 13 with the guides 19, 21. This face-to-face contact state is maintained even during normal key-depressing operation in which the keys 2, 3, and 4, are vertically swung while the guided projections 11, 13 smoothly slide on the walls of the guides 19, 21.

Further, movement of the guided projections 11, 12, and 13 within the respective channels 19M, 20M, and 21M in the transverse direction is restrained, so that swinging of the keys 2, 3, and 4 in the transverse direction can be properly restrained (key-guiding function) during key-depressing operation of the key unit 1 to play glissando or the like. Still further, proper gaps between the keys can be secured to improve the appearance.

According to the present embodiment, the key unit 1 is molded in one piece from a mold and in a free state the keys 2, 4 are bent about the vertical portions 5*a*, 7*a* of the connecting portions 5, 7, extending diagonally to the left and right of the connecting portions 5, 7, respectively, such that the gaps 9, 10 become progressively larger towards the front ends of the keys. Therefore, it can be avoided that the ribs of the mold corresponding to the gaps 9, 10 have a very small thickness, thereby facilitating the design and manufacture of the mold, and improving the strength as well as prolonging the life.

Besides, the key unit 1 can be easily corrected from its expanded state by resiliently deforming the vertical portions 5*a*, 7*a* of the connecting portions 5, 7 which are small in mass and hence have a small restitution force. Therefore, in mounting the key unit 1 into the frame 14, the keys 2, 3, 4 can be made to run parallel with each other merely by inserting the guided projections 11, 12, and 13 into the guides 19, 20, 21, which does not require complicated manufacturing steps nor adversely affect the quality and performance.

Further, since the dimensional and positional relationship between the channels 19M, 20M, and 21M and the guided projections 11, 12, and 13 is properly set as described above, it can be assured that the guided projections 11, 13 and the guides 19, 21 are always maintained in one-side face-to-face contact with each other with proper clearances therebetween, thereby being free from generation of mechanical noise during key-depressing operation.

Still further, the guides 19, 21 and guided projections 11, 13, which are already provided in conventional keyboard assemblies for performing the key-guiding function, also perform a function of straightening the key unit from its expanded state, thereby simplifying the construction of the keyboard assembly.

Although in the above described embodiment the guided projections 11, 13 and the guides 19, 21 are brought into and maintained in urging and slidable face-to-face contact with each other, alternatively protuberances may be provided on the guided projections 11, 13 or the guides 19, 21 so that the guided projections 11, 13 and the guides 19, 21 are brought into and maintained in urging and slidable point contact with each other.

The number of keys of the key unit 1 is not limited to three, keys may be provided in units of octave (C key- B key), for example. In such a case, the dimensional and positional relationship between the guides and the guided projections may be set similarly to the key 2 in the above described embodiment for C, D, and E keys such that the left side surface of the guided projection is in urging face-to-face contact with the right side surface of the left wall of the guide, similarly to the key 4 in the above described embodiments for G, A, and B keys such that the right side surface of the guided projection is in urging face-to-face contact with the left side surface of the right wall of the guide, and similarly to the key 3 in the above described embodiment for an F key arranged at a central portion of the key unit such that the guided projection is always spaced from the guide without contacting the same.

Figure 8:
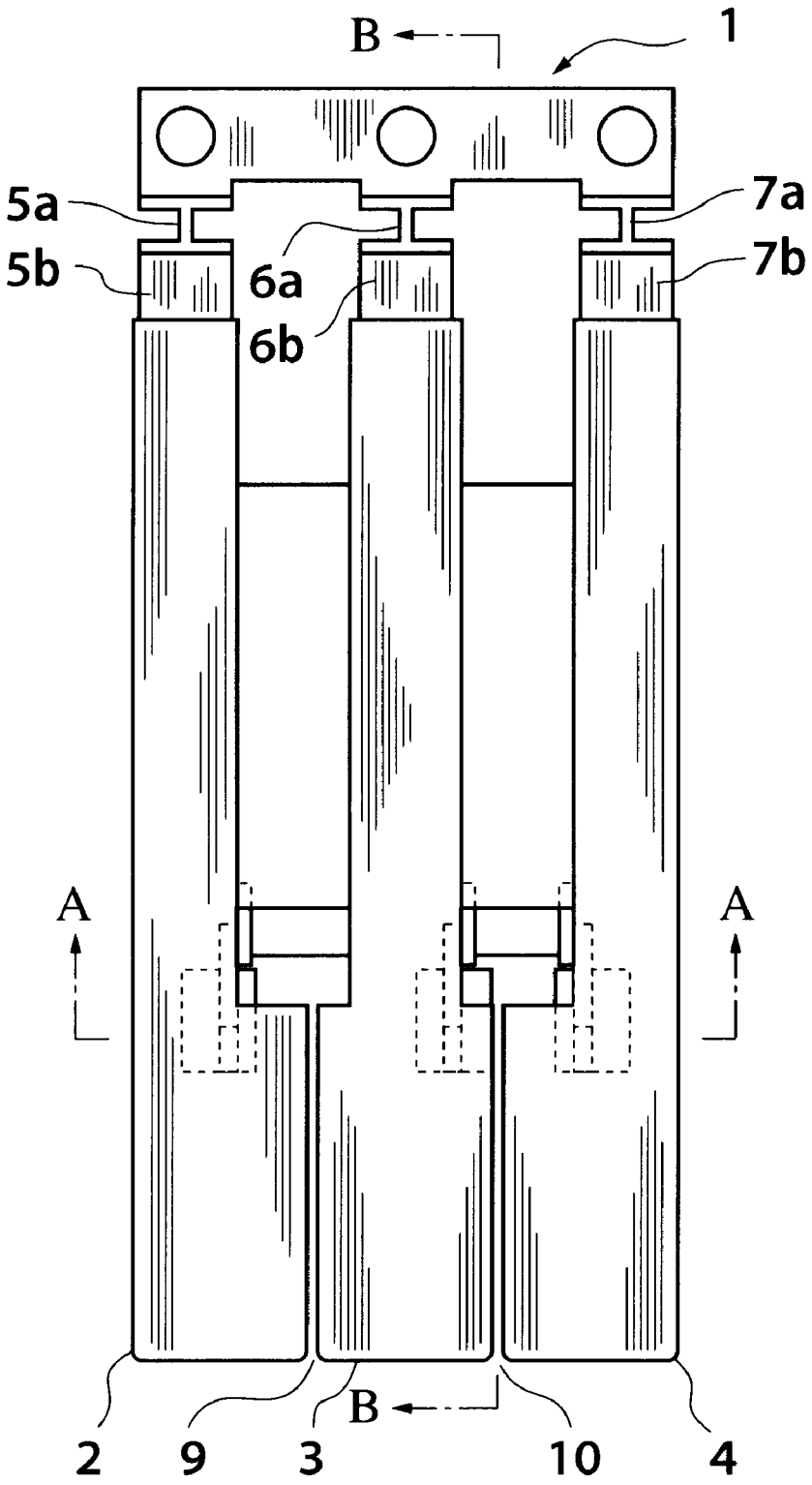
FIG. 8 is a similar view to FIG. 3, showing a key unit of a keyboard assembly according to a second embodiment of the invention which is mounted in a frame.
Figure 9:
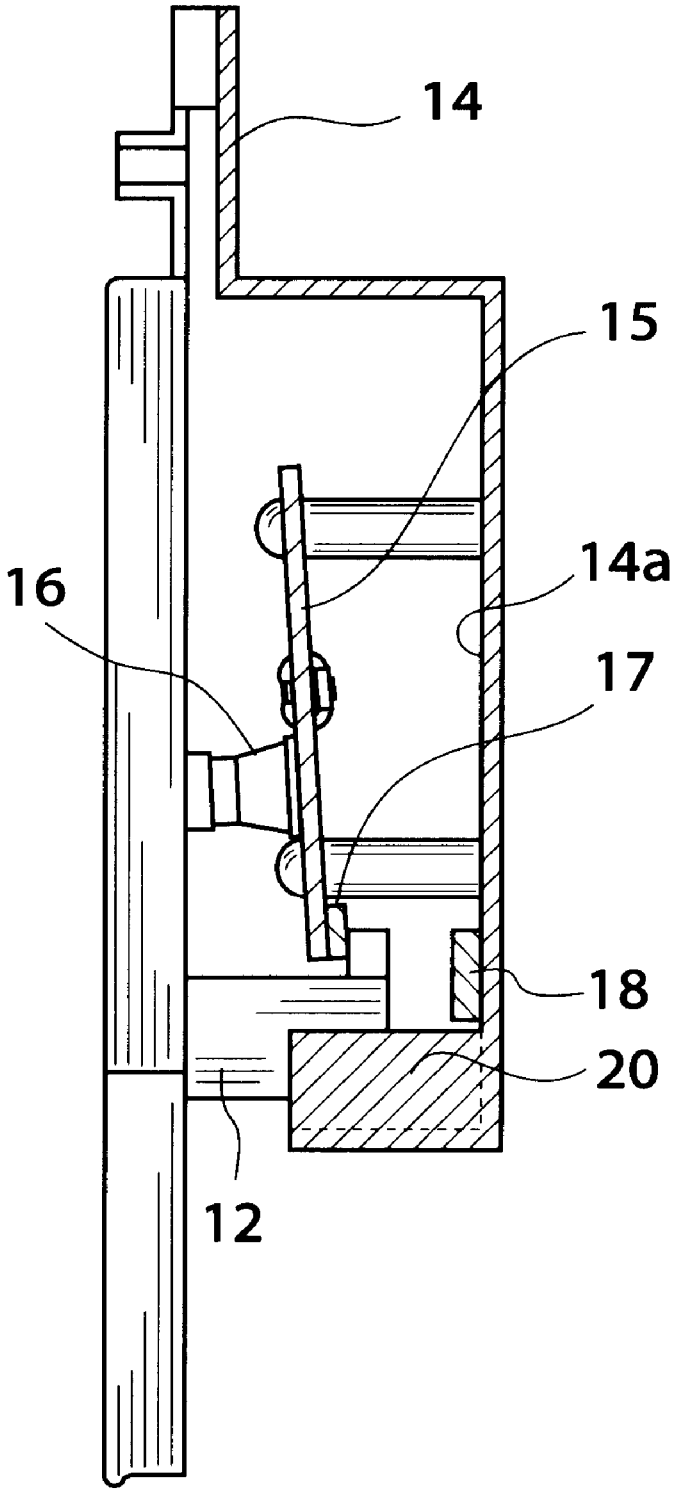
FIG. 9 is a sectional view taken along line B—B in FIG. 8.
Figure 10:
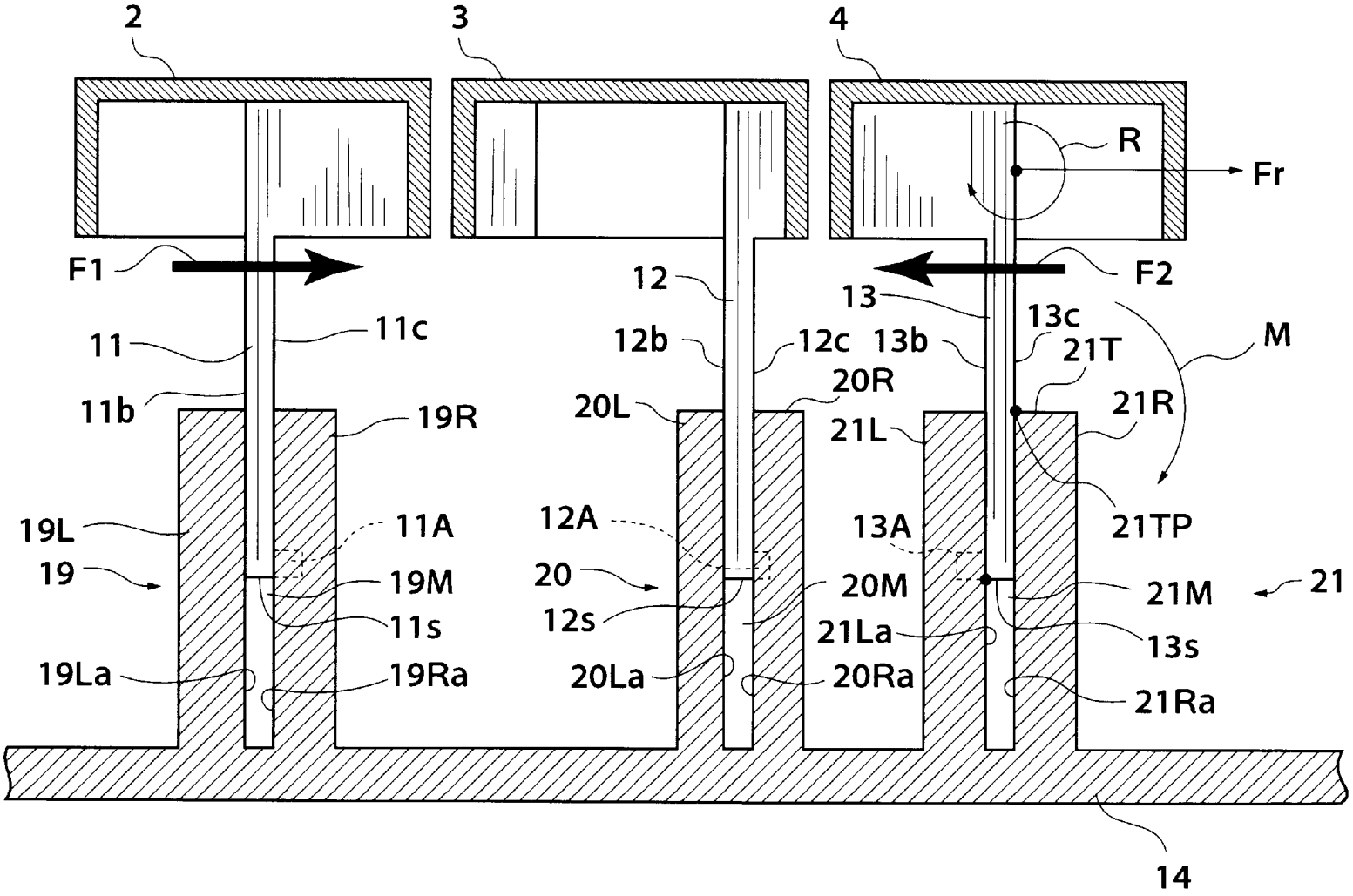
FIG. 10 is a similar view to FIG. 7, showing in detail keys and guides of the keyboard assembly according to the second embodiment.

Next, a second embodiment of the invention will be described with reference to FIGS. 8 to 10. FIGS. 8 and 9 show a key unit 1 of a keyboard assembly according to the second embodiment in a state mounted in a frame 14. FIG. 10 shows keys and guides on an enlarged scale. In these figures, elements and parts corresponding to those in FIGS. 1 to 7 showing the first embodiment described above are designated by identical reference numerals, detailed description of which is omitted.

The second embodiment is distinguished from the first embodiment in that the guides 19, 20, and 21 each have an increased size as viewed in a longitudinal direction of the key compared with those of the first embodiment, as shown e.g. in FIG. 9 showing the guide 20, to increase an area of contact between the guide 19, 20, 21 and the guided projection 11, 12, 13, and, as shown in FIG. 10, the gap or space between the left and right walls 19L, 19R: 20L, 20R; 21L, 21R of each of the guides 19, 20, 21, i.e. the width of each of the channels 19M, 20M, and 21M is reduced compared with that in the first embodiment so that the guided projections 11, 12, and 13 are each inserted or fitted in a corresponding one of the channels 19M, 20M, and 21M in a fashion being sandwiched at opposite side surfaces 11*b*, 11*c*; 12*b*, 12*c*; 13*b*, 13*c* thereof between the pair of walls 19L, 19R: 20L, 20R; 21L, 21R of a corresponding one of the guides 19, 20, and 21 (face-to-face contact).

By thus engaging the guides 19, 20, and 21 and the guided projections 11, 12, and 13 which are formed as mentioned above, the pair of walls 19L, 19R: 20L, 20R; 21L, 21R of the guides, the pair of walls 19L, 19R: 20L, 20R; 21L, 21R of the guides 19, 20, and 21 can be brought into face-to-face contact with the respective pairs of left and right side surfaces 11*b*, 11*c*; 12*b*, 12*c*; 13*b*, 13*c* of the guided projections 11, 12, and 13 at both lateral sides of the keys 2, 3, and 4 and over large areas to restrain movement of the keys and hence prevent rolling of the keys about longitudinal axes thereof, resulting in stable swinging motions of the keys when they are depressed and released. In actuality, there exist very small clearances (not shown) between the left and right side surfaces 11*b*, 11*c*; 12*b*, 12*c*; 13*b*, 13*c* of the guided projections 11, 12, and 13 and the walls 19L, 19R: 20L, 20R; 21L, 21R of the guides 19, 20, and 21 so as to permit smooth sliding motions of the keys when they are depressed and released.

In the above described manner, the correction of the gaps 9 and 10 is achieved by the face-to-face contact of the opposite side surfaces of the guided projections 11, 13 with the guides 19, 21. This face-to-face contact state is maintained even during normal key-depressing operation in which the keys 2, 3, and 4, are vertically swung while the guided projections 11, 13 smoothly slide on the walls of the guides 19, 21.

This smooth sliding movement of the guided projections 11, 13 can be more positively realized due to the following structure: As shown in FIG. 10, free ends or tips 11*s*, 12*s*, and 13*s* of the guided projections 11, 12, and 13 are positioned at locations remote from the respective connecting portions 5, 6, and 7 as well as from top portions of the respective guides 19, 20, and 21 as viewed in the direction of depression and release of the keys 2, 3, and 4, such that the connecting portion 5, 6, 7, the top portion of the guide 19, 20, 21, and the free end 11*s*, 12*s*, 13*s* of the guided projection 11, 12, 13 are arranged in the order mentioned in the direction of depression and release of the keys 2, 3, and 4, whereby rolling R of the keys about the longitudinal axes thereof is very unlikely to occur. This will be explained with respect to a right key portion in FIG. 10, for example. The connecting portion 7 (see FIGS. 1 and 3) always produces a biasing force Fr in a direction indicated by an arrow in FIG. 10, and accordingly rotation moment M is produced, which acts upon the key 4 to rotate the same about a top end 21TP of the top porion 21T in a clockwise direction. The free end 13*s*, however, urges a wall surface 21L*a* of the wall 21L to restrain the rotation of the key 4 and keep the same in a balanced state (it can be considered that reverse rotation moment $\overline{M}$ is produced to keep the key in a balanced state).

In view of this, it is desirable to provide means for cancelling the force Fr at a location as remote as possible from a location at which the force Fr is produced, with respect to the top end 21TP. To this end, the free end 13*s* of the guided projection 13 acts as such means. When this action is viewed from the connecting portion 7 side, it will be learned that rolling of the key due to the force Fr is unlikely to occur even when the key is depressed and released. Since the keyboard assembly thus has a structure almost free from rolling of the keys, stable and smooth swinging motions of the keys can be ensured when they are depressed and released.

What is claimed is:

1. A keyboard assembly comprising:

at least one key unit including a plurality of keys each having a front end and a base end, a common key support supporting said keys, and a connecting portion provided on said base end of each of said keys and connecting said each of said keys with said common key support, said keys being formed integrally with said connecting portion and said common key support in a manner such that said keys are each connected via said connecting portion to said common key support for swinging about said common key support in a direction of depression and release of said keys and in a direction in which said keys are juxtaposed, said keys defining gaps therebetween, each of said gaps becoming progressively larger toward said front end of an associated one of said keys;

a frame in which said key unit is mounted; and engaging means provided on said keys and said frame, for causing said keys to run parallel with each other by deforming said connecting portion of said each of said keys to thereby engage said key unit with said frame.

2. A keyboard assembly as claimed in claim 1, wherein said engaging means comprises guide means provided on said frame, and guided means provided on each of said keys and engaging a corresponding one of said guide means, said keys being caused to run parallel with each other by engagement of said guide means with said guided means.

3. A keyboard assembly as claimed in claim 2, wherein said guide means are configurated so as to cooperate with said guided means to restrain swinging of said keys in said direction in which said keys are juxtaposed when said keys are depressed.

4. A keyboard assembly as claimed in claim 2, wherein said guide means and said guided means are in urging face-to-face contact with each other to thereby cause said keys to run parallel with each other.

5. A keyboard assembly as claimed in claim 2, wherein said guide means comprises a pair of walls provided on said frame at a location corresponding to each of said keys and defining a channel therebetween, said pair of walls having opposite side surfaces and extending parallel with a longitudinal axis of said each of said keys when said key unit is mounted in said frame, said pair of walls being spaced from each other and defining said channel therebetween, said guided means comprising a projection provided on said each of said keys and extending parallel with the longitudinal axis of said each of said keys, said projection being inserted in said channel between said pair of walls of a corresponding one of said guide means.

6. A keyboard assembly as claimed in claim 1, wherein said connecting portion of said key unit is bent in said direction in which said keys are juxtaposed, such that each of said gaps becomes progressively larger toward said front end of an associated one of said keys.

7. A keyboard assembly as claimed in claim 1, wherein said connecting portion comprises a vertically extending portion located closer to said key support and allowing said each of said keys to be bent about said vertically extending portion while allowing said each of said keys to be swung in said direction in which said keys are juxtaposed, and a horizontally extending portion located closer to said each of said keys and allowing said each of said keys to be swung in said direction of depression and release of said keys.

8. A keyboard assembly as claimed in claim 2, wherein said each of said keys has a side surface, and said guided means comprises a first projection provided on said each of said keys for engagement with a corresponding one of said guide means, and a second projection projected from said first projection outwardly of said side surface of said each of said keys in said direction in which said keys are juxtaposed.

9. A keyboard assembly as claimed in claim 8, including a stopper provided on said frame, and wherein said second projection of said guided means has an engaging surface disposed for abutment with said stopper when said each of said keys is released, to limit an extreme position of said each of said keys.

10. A keyboard assembly as claimed in claim 2, wherein said guide means comprises a pair of walls provided on said frame at a location corresponding to each of said keys and defining a channel therebetween, said pair of walls having opposite side surfaces and extending parallel with a longitudinal axis of said each of said keys when said key unit is mounted in said frame, said pair of walls being spaced from each other and defining said channel therebetween, said guided means comprising a projection provided on said each of said keys and extending parallel with the longitudinal axis of said each of said keys, said projection being inserted in said channel between said pair of walls of a corresponding one of said guide means in a fashion such that said projection is sandwiched at said opposite side surfaces thereof between said pair of walls.

* * * * *